US008563205B2

(12) United States Patent
Iwazaki et al.

(10) Patent No.: US 8,563,205 B2
(45) **Date of Patent: *Oct. 22, 2013**

(54) MAGENTA TONER, DEVELOPER, TONER CARTRIDGE, PROCESS CARTRIDGE, IMAGE FORMING APPARATUS, AND IMAGE FORMING METHOD

(75) Inventors: Eisuke Iwazaki, Kanagawa (JP); Shinya Sakamoto, Kanagawa (JP); Tsuyoshi Murakami, Kanagawa (JP); Satoshi Yoshida, Kanagawa (JP); Satoshi Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/224,969

(22) Filed: Sep. 2, 2011

(65) Prior Publication Data

US 2012/0183895 A1 Jul. 19, 2012

(30) Foreign Application Priority Data

Jan. 13, 2011 (JP) ..... 2011-005029

(51) Int. Cl.
*G03G 9/00* (2006.01)

(52) U.S. Cl.
USPC ..... 430/105; 430/109.4; 430/108.8; 399/111; 399/252

(58) Field of Classification Search
USPC ..... 430/105, 109.4, 108.8; 399/111, 252
See application file for complete search history.

(56) References Cited

U.S. PATENT DOCUMENTS

2005/0112492 A1 5/2005 Makino et al.
2007/0048646 A1* 3/2007 Sasaki et al. ..... 430/109.4
2008/0261141 A1 10/2008 Yasukawa et al.
2009/0239171 A1 9/2009 Anno et al.
2009/0239174 A1* 9/2009 Inaba et al. ..... 430/112
2009/0245858 A1* 10/2009 Mizutani et al. ..... 399/111

FOREIGN PATENT DOCUMENTS

JP A-2002-341594 11/2002
JP A-2005-258394 9/2005
JP A-2006-313302 11/2006
JP A-2008-287239 11/2008

(Continued)

OTHER PUBLICATIONS

Oct. 4, 2012 Office Action issued in U.S. Appl. No. 13/019,694, filed Feb. 2, 2011.
U.S. Appl. No. 13/352,786, filed Jan. 18, 2012.
Mar. 25, 2013 Office Action issued in U.S. Appl. No. 13/352,786.

(Continued)

*Primary Examiner* — Mark F Huff
*Assistant Examiner* — Rachel Zhang
(74) *Attorney, Agent, or Firm* — Oliff & Berridge, PLC

(57) ABSTRACT

Provided is a magenta toner containing toner particles that contain a colorant and a binder resin, wherein the colorant contains C.I. Pigment Red 57:1 and C.I. Pigment Yellow 180, a mass ratio between the C.I. Pigment Red 57:1 and the C.I. Pigment Yellow 180 being 99:1 to 10000:1, and wherein the binder resin contains a polyester resin that has a repeating unit derived from bisphenol A ethylene oxide represented by formula (1):

(1)

wherein each of m and n independently represents an integer of 2 to 4.

18 Claims, 3 Drawing Sheets

(56) References Cited

FOREIGN PATENT DOCUMENTS

| | | |
|---|---|---|
| JP | A-2009-204774 | 9/2009 |
| JP | A-2009-258681 | 11/2009 |
| JP | A-2009-300733 | 12/2009 |

OTHER PUBLICATIONS

Jun. 20, 2013 Notice of Allowance issued in U.S. Appl. No. 13/352,786.

* cited by examiner

MAGENTA TONER, DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-005029 filed on Jan. 13, 2011.

BACKGROUND

1. Technical Field

The present invention relates to a magenta toner, a developer, a toner cartridge, a process cartridge, an image forming apparatus, and an image forming method.

2. Related Art

Currently, a method of visualizing image information by forming an electrostatic latent image and developing this latent image, such as an electrophotography method, is used in various fields. In this method, the entire surface of a photoreceptor (latent image holding member) is charged, an electrostatic latent image is formed by laser exposure on the photoreceptor surface according to image information, a toner image is formed by developing this electrostatic latent image with a developer including a toner, and this toner image is finally transferred and fixed to the surface of a recording medium, whereby an image is formed.

The toner used for the electrophotography method is generally prepared by a kneading and pulverizing method in which a thermoplastic resin is molten and kneaded together with a pigment, a charge control material, a release agent, and a magnetic material, followed by cooling, and then finely pulverized and classified.

SUMMARY

That is, according to an aspect of the invention, there is provided a magenta toner containing toner particles that contain a colorant and a binder resin, wherein the colorant contains C.I. Pigment Red 57:1 and C.I. Pigment Yellow 180, a mass ratio between the C.I. Pigment Red 57:1 and the C.I. Pigment Yellow 180 being about 99:1 to about 10000:1, and wherein the binder resin contains a polyester resin that has a repeating unit derived from bisphenol A ethylene oxide represented by the following formula (1):

(1)

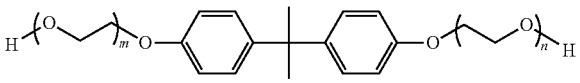

wherein each of m and n independently represents an integer of from 2 to 4.

BRIEF DESCRIPTION OF THE DRAWINGS

Exemplary embodiments of the present invention will be described in detail based on the following figures, wherein.

DETAILED DESCRIPTION

Figure 1:
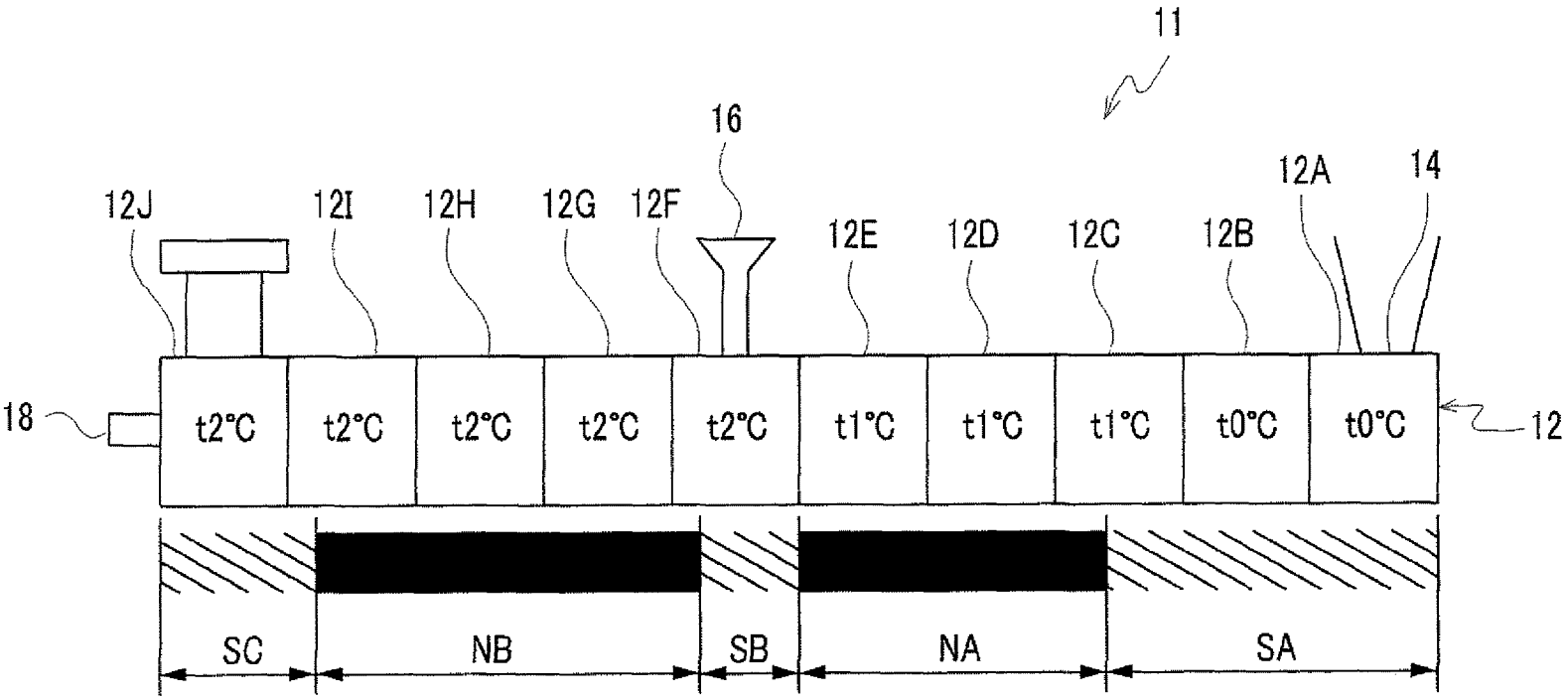
FIG. 1 is a view illustrating a state of a screw of an exemplary screw extruder used for preparing a magenta toner according to the exemplary embodiment.

Hereinafter, an exemplary embodiment of a magenta toner, a developer, a toner cartridge, a process cartridge, an image forming apparatus, and an image forming method according to the invention will be described in detail.

<Magenta Toner>

The magenta toner according to the exemplary embodiment (hereinafter, referred to as the toner of the exemplary embodiment in some cases) contains toner particles that contain a colorant and a binder resin, wherein C.I. Pigment Red 57:1 and C.I. Pigment Yellow 180 are used as the colorant, a mass ratio between the C.I. Pigment Red 57:1 and the C.I. Pigment Yellow 180 is 99:1 to 10000:1 (or about 99:1 to about 10000:1), and a polyester resin that has a repeating unit derived from bisphenol A ethylene oxide represented by the following formula (1) is used as the binder resin.

(1)

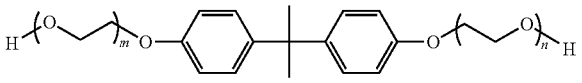

In formula (1), each of m and n independently represents an integer of 2 to 4.

It is unclear why the deterioration of blue image reproducibility is suppressed by the use of the toner of the exemplary embodiment. However, the following reasons are assumed.

A blue image is obtained in a manner in which color toners are superimposed on each other in an order of a magenta toner and a cyan toner on an intermediate transfer member such as an intermediate transfer belt or the like to form a superimposed toner image, and the superimposed toner image is transferred to a recording medium, and then fixed thereto. In reproducing blue of secondary colors obtained by a combination of magenta and cyan, the magenta toner of the uppermost layer is required to be transparent. The C.I. Pigment Red 57:1 which is a colorant having a violent blue hue is preferable in respect of blue reproducibility. However, the C.I. Pigment Red 57:1 has poor pigment dispersibility and is apt to be aggregated in a toner during the preparation of the toner. Accordingly, the transparency of the C.I. Pigment Red 57:1 is low during toner fixing, so secondary color reproducibility thereof is lowered in some cases. Particularly, during repeated copying, reproducibility of the C.I. Pigment Red 57:1 is lowered in some cases.

The present inventors have found that by adding a small amount of C.I. Pigment Yellow 180 (PY 180) to the C.I. Pigment Red 57:1 (PR 57:1) in preparing a toner, the dispersibility of the C.I. Pigment Red 57:1 in the toner is improved, and the transparency is improved, whereby high blue reproducibility is obtained.

The aggregation of the C.I. Pigment Red 57:1 during the preparation of the toner is assumed to be a result of cohesive force caused by Ca metal ions. The PY 180 includes lots of carboxyl groups and amide groups as well as a bulky structure; therefore, shared electron pairs at oxygen portions are firmly coordinated with the Ca ions, thereby neutralizing the cohesive force. In addition, the bulky structure of the PY 180 is assumed to be able to sterically inhibit magenta pigments from being aggregated to each other.

The present inventors also found that by using a polyester resin having a repeating unit derived from bisphenol A ethylene oxide represented by formula (1), pigment aggregation is further suppressed. In the polyester resin having a repeating unit derived from bisphenol A ethylene oxide represented by formula (1), the C.I. Pigment Red 57:1 exhibits excellent dispersibility, and the pigment aggregation is suppressed. Presumably, pigments are excellently dispersed since the oxygen portion of the repeating unit derived from bisphenol A ethylene oxide represented by formula (1) neutralizes the Ca ions of the C.I. Pigment Red 57:1 so as to enable molecules to intertwine with each other while suppressing the pigment aggregation.

In the exemplary embodiment, as a cyan toner used in combination with the toner of the exemplary embodiment during blue image formation, a toner containing phthalocyanine-based pigments as a colorant is preferable.

Hereinafter, the configuration of the toner of the exemplary embodiment will be described.

The toner of the exemplary embodiment contains toner particles that contain a colorant and a binder resin, and may optionally contain external additives.

—Colorant—

In the exemplary embodiment, the C.I. Pigment Red 57:1 and the C.I. Pigment Yellow 180 are used in combination as the colorants.

In the exemplary embodiment, the mass ratio between the C.I. Pigment Red 57:1 and the C.I. Pigment Yellow 180 is set to 99:1 to 10000:1. If the ratio of the C.I. Pigment Red 57:1 is smaller than 99:1, a yellow hue becomes strong, which leads to a problem of the deterioration of blue reproducibility in some cases. On the other hand, if the ratio of the C.I. Pigment Red 57:1 is larger than 10000:1, the C.I. Pigment Red 57:1 is apt to be aggregated, so the pigment dispersibility deteriorates, which leads to a problem of the deterioration of blue reproducibility in some cases. The mass ratio between the C.I. Pigment Red 57:1 and the C.I. Pigment Yellow 180 is preferably 500:1 to 5000:1 (or about 500:1 to about 5000:1), and more preferably 700:1 to 2000:1.

The total amount of the colorants contained in the toner particles according to the exemplary embodiment is preferably in a ratio of from 1 part by mass to 20 parts by mass based on 100 parts by mass of a binder resin.

In the exemplary embodiment, the C.I. Pigment Yellow 180 is indispensably used. If yellow pigments other than the C.I. Pigment Yellow 180 are used, the bulkiness and the neutralization force with respect to the Ca of the C.I. Pigment Red 57:1 vary. Therefore, the C.I. Pigment Red 57:1 is aggregated, so the deterioration of the blue reproducibility fails to be suppressed in some cases.

As to a method of detecting the C.I. Pigment Yellow 180 (PY 180) and the C.I. Pigment Red 57:1 in the toner, after a toluene-insoluble portion in the toner is extracted, through weight measurement, IR and fluorescent X-ray analyses, and an NMR analysis, it is possible to calculate the PY 180 amount, the C.I. Pigment Red 57:1 amount, and a ratio of PR 57:1 amount/PY 180 amount.

It is also possible to measure the mass ratio between the C.I. Pigment Yellow 180 and the C.I. Pigment Red 57:1 by the following method.

Ionization conducted by direct laser irradiation to a THF insoluble portion of the toner is performed by Laser Desorption/Ionization (LDI).

More specifically, 1 g of the toner is dissolved in THF, followed by filtration, and then the filtrated portion is dried. The filtrated portion is crushed in a mortar and suspended in a THF/MeOH (1/1) solution, whereby a sample is obtained.

By using an MS unit of an ion trap type GC-MS (POLARIS Q) manufactured by Thermo Fisher Scientific Inc. as a measurement device, and through a direct sample introduction method, mass analysis is performed under the following analysis conditions.

Analysis conditions:
GC-MS: POLARIS Q
Ion Source Temp: 200° C.
Electron Energy: 70 eV
Emission Current: 250 μA
Mass Range: m/z 50-1000
Reagent Gas: Methane
Direct Sample Exposure Probe (DEP)
Rate: 20 mA (10 sec)-5 mA/sec-1000 mA (30 sec)
Mass of PY 180: 706
Mass of C.I. Pigment Red 57:1:424.1

By a peak ratio of the above components, a pigment ratio is calculated.

—Binder Resin—

In the exemplary embodiment, a polyester resin having a repeating unit derived from bisphenol A ethylene oxide represented by formula (1) is used as a binder resin. The polyester resin is obtained by polymerization of dicarboxylic acid and diol as polymerizable monomers. The bisphenol A ethylene oxide represented by formula (1) is used as a diol component of the polyester resin.

In the exemplary embodiment, the "repeating unit derived from bisphenol A ethylene oxide represented by formula (1)" refers to a configurational portion of the polyester resin, which is bisphenol A ethylene oxide represented by formula (1) before the polymerization reaction.

If m and n in formula (1) are 1, hydrophilicity of the resin is heightened, so dispersibility to a colorant having a high hydrophobicity deteriorates in some cases.

On the other hand, if m and n in formula (1) are 5 or greater, chargeability of the toner easily changes, so it is difficult to control the amount of toner attached in developing and transferring in some cases.

In formula (1), m and n are preferably in a range of 3 to 4.

In the exemplary embodiment, in synthesizing the polyester resin, diols other than the bisphenol A ethylene oxide represented by formula (1) may be used in combination. Examples of the other diols include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as a propylene oxide adduct of bisphenol A.

In the exemplary embodiment, the proportion of the repeating unit derived from bisphenol A ethylene oxide represented by formula (1) accounting for all of the repeating units derived from diol is preferably from 10 mol % or more, more preferably from 80 mol % or more (or from about 80 mol % or more), and particularly preferably 100 mol %.

Examples of a dicarboxylic acid used in the exemplary embodiment include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid, and 1 or 2 or more kinds of these polyvalent carboxylic acids may be used.

It is possible to prepare the polyester resin at a polymerization temperature of from 180° C. to 230° C., and the reaction is performed while pressure inside the reaction system is optionally reduced, and water and alcohol generated during condensation are removed.

If the polymerizable monomers such as dicarboxylic acid and diol are not dissolved or incompatible at the reaction temperature, a solvent having a high boiling point may be added as a solubilizing agent to dissolve the monomers. In this case, polycondensation reaction is performed while the solubilizing agent is distilled away. When there are polymerizable monomers having poor compatibility in the copolymerization reaction, the polymerizable monomers having poor compatibility and acids or alcohols supposed to be polycondensed with the polymerizable monomers may be condensed in advance, and then the resultant may be polycondensed with principal components.

Examples of usable catalysts in preparing the polyester resin include alkali metal compounds such as sodium and lithium compounds; akaline earth metal compounds such as magnesium and calcium compounds; metal compounds such as zinc, manganese, antimony, titanium, tin, zirconium, and germanium compounds; phosphorous acid compounds; phosphoric acid compounds; and amine compounds.

Specific examples of the compounds include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyl triphenylphosphonium bromide, triethylamine, and triphenylamine.

The glass transition temperature (Tg) of the polyester resin used in the exemplary embodiment is preferably in a range of from 35° C. to 50° C. If the Tg is 35° C. or higher, it is possible to prevent problems in toner storability and fixed image storability in some cases. If the Tg is 50° C. or lower, it is possible to perform fixing at a lower temperature compared to the related art.

The Tg of the polyester resin is more preferably from 45° C. to 50° C.

The glass transition temperature of the polyester resin is determined as a peak temperature of the endothermic peak obtained by differential scanning calorimetry (DSC).

The weight average molecular weight of the polyester resin used in the exemplary embodiment is preferably from 5000 to 30000, and more preferably from 7000 to 20000.

The weight average molecular weight is measured by Gel Permeation Chromatography (GPC). In the molecular weight measurement performed by GPC, HLC-8120 as a GPC manufactured by TOSOH CORPORATION is used as a measurement device, TSKgel SuperHM-M (15 cm) as a column manufactured by TOSOH CORPORATION is used, and THF is used as a solvent. The weight average molecular weight is calculated using a molecular weight calibration curve created by a standard sample of monodisperse polystyrene from the measured results.

In the exemplary embodiment, optionally, polyester resins other than the above specific polyester resins; ethylene-based resins such as polyethylene and polypropylene; styrene-based resins including polystyrene, poly(α-methylstyrene), and the like as principle components; (meth) acryl-based resins including polymethyl(meth)acrylate, poly(meth)acrylonitrile, and the like as principle components; polyimide resins; polycarbonate resins; polyether resins; and copolymerized resins thereof are used in combination as the binder resin.

The total amount of the binder resin contained in the toner particles according to the exemplary embodiment is preferably from 40% by mass to 95% by mass, and more preferably from 60% by mass to 85% by mass, based on the total mass of the solid content of the toner particles.

—Release Agent—

In the exemplary embodiment, the toner particles may contain a release agent. Specific examples of the release agent include low molecular weight polyolefins such as polyethylene, polypropylene, and polybutene; silicones having a softening point; fatty acid amides such as oleamide, erucamide, ricinoleamide, stearamide; vegetable waxes such as carnauba wax, rice wax, candelilla wax, Japanese wax, and jojoba oil; animal waxes such as beeswax; mineral and petroleum-based waxes such as montan wax, ozokerite, ceresin, paraffin wax, microcrystalline wax, and Fischer-Tropsch wax; ester waxes of higher fatty acids with higher alcohols such as stearyl stearate and behenyl behenate; ester waxes of higher fatty acids with lower monols or lower polyols such as butyl stearate, propyl oleate, monostearic acid glyceride, distearic acid glyceride, and pentaerythritol tetrabehenate; ester waxes formed of higher fatty acid and polyol multimers such as diethylene glycol monostearate, dipropylene glycol distearate, distearic acid diglyceride, and tetrastearic acid triglyceride; sorbitan higher fatty acid ester waxes such as sorbitan monostearate; and cholesterol higher fatty acid ester waxes such as cholesteryl stearate.

These release agents may be used alone or in combination of 2 or more kinds thereof.

Among these, hydrocarbon-based wax is preferable. Using the hydrocarbon-based wax as the release agent improves the dispersibility of the C.I. Pigment Red 57:1 contained in the toner of the exemplary embodiment. The hydrocarbon-based wax having a low polarity shows a low compatibility with the resin and a high dispersibility in the toner, and is easily compatible with a naphthalene portion of the C.I. Pigment Red 57:1. Therefore, it is considered that the deterioration of blue image reproducibility is further suppressed since the dispersibility of the C.I. Pigment Red 57:1 is improved while the aggregation of the C.I. Pigment Red 57:1 is suppressed.

Among the hydrocarbon-based waxes, mineral and petroleum-based waxes such as paraffin-based wax, microcrystalline wax, and Fischer-Tropsch wax, and polyalkylene wax which is a modified product thereof are preferable in respect that these waxes are uniformly eluted to the surface of a fixed image in fixing and that a proper thickness of a release agent layer is obtained, for example. The paraffin-based wax is more preferable as the hydrocarbon-based wax.

The amount of these release agents to be added is preferably from 1% by mass to 20% by mass, and more preferably from 5% by mass to 15% by mass, based on the total mass of the solid content of the toner particles.

—Other Components—

In addition to the above-described binder resin and colorants, other components (particles) such as internal additives, charge control agents, organic particles, lubricants, and abrasives may be added to the toner particles according to the purpose.

An example of the internal additive includes magnetic powder. It is possible to add the magnetic powder when the toner is used as a magnetic toner. As the magnetic powder, materials magnetized in a magnetic field are used, and examples thereof include metals such as reduced iron, cobalt, manganese, and nickel, alloys, and ferrite, magnetite and compounds containing these metals.

As the charge control agent, it is possible to preferably use the colorless one or the light-colored one, but there is no particular limitation. Examples of the charge control agent include dyes formed of a complex of such as a quaternary ammonium salt compound, a nigrosine-based compound, aluminum, iron, chromium; and a triphenylmethane-based pigment.

Examples of the organic particle include all kinds of particles generally used as the external additives for the toner surface, such as a vinyl-based resin, a polyester resin, and a silicone resin. It is possible to use these organic particles as a fluidity aid, and a cleaning aid, for example.

Examples of the lubricant include fatty acid amides such as ethylene bis-stearyl acid amide and oleamide; and fatty acid metal salts such as zinc stearate and calcium stearate.

Examples of the abrasive include silica, alumina, and cerium oxide.

The content of the other components described above may be in such a degree that the purpose of the exemplary embodiment is not inhibited, and generally, the components are contained in an extremely small amount. Specifically, the content of the components is preferably in a range of from 0.01% by mass to 5% by mass, and more preferably in a range of from 0.5% by mass to 2% by mass, based on the total mass of the solid content of the toner particles.

—External Additives—

The toner of the exemplary embodiment may contain external additives.

Examples of the external additives include silica, alumina, titanium oxide, barium titanate, magnesium titanate, calcium titanate, strontium titanate, zinc oxide, silica sand, clay, mica, wollastonite, diatom earth, cerium chloride, red iron oxide, chromium oxide, cerium oxide, antimony trioxide, magnesium oxide, zirconium oxide, silicon carbide, and silicon nitride. Among these, silica particles and/or titania particles are preferable, and hydrophobized silica particles and titania particles are particularly preferable.

As a method of surface modification such as hydrophobization, well-known methods are used. Specific examples thereof include each of coupling treatments with silanes, or using titanates or aluminates. Suitable examples of the coupling agent used for the coupling treatment include, but are not limited to, silane coupling agents such as methyltrimethoxysilane, phenyltrimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane, and hexamethyldisilazane; titanate coupling agents; and aluminate coupling agents.

In addition, various additives may be externally added optionally, and examples of the additives include other fludizers, cleaning aids such as polystyrene particles, polymethylmethacrylate particles, and polyvinylidene fluoride particles, and abrasives such as zinc stearyl amide and strontium titanate which are used for removing substances attached to the photoreceptor.

The amount of the external additives to be added is preferably in a range of from 0.1 part by mass to 5 parts by mass, and more preferably in a range of from 0.3 part by mass to 2 parts by mass, based on 100 parts by mass of the toner particles. If the added amount is 0.1 part by mass or more, fluidity of the toner is secured. On the other hand, if the added amount is 5 parts by mass or less, occurrence of a secondary hindrance which is caused by transition of surplus inorganic oxides resulting from an excessively coated state to a contact member is suppressed.

(Characteristics of Toner)

It is preferable that the shape coefficient SF1 of the toner of the exemplary embodiment be in a range of from 140 to 160 (or from about 140 to about 160). If the shape coefficient SF1 of the toner is in the above range, the toner has an irregular shape, whereby toner scattering caused by rolling of the fixed toner image is suppressed, and a convex portion of the toner is generated. Accordingly, an area where the toners contact each other is reduced, so the contact of the C.I. Pigment Red 57:1 on the toner surface is reduced, whereby it is difficult for the C.I. Pigment Red 57:1 to be aggregated in fixing. Therefore, the dispersibility of the C.I. Pigment Red 57:1 in a fixed image becomes excellent, and as a result, the deterioration of the blue image reproducibility is further suppressed.

It is more preferable that the shape coefficient SF1 is in a range of from 145 to 155.

The shape coefficient SF1 is determined by the following formula (2).

$$SF1=(ML^2/A)\times(\pi/4)\times 100 \quad (2)$$

In formula (2), ML represents an absolute maximum length of the toner particles, and A represents a projection area of the toner particles, respectively.

Generally, the SF1 is digitalized by the analysis of a microscopic image or a scanning electron microscopic (SEM) image through an image analyzer, and is calculated in the following manner, for example. That is, an optical microscopic image of particles dispersed on the surface of a slide glass is provided to a Luzex image analyzer though a video camera, the maximum length and projection area of 100 particles are determined and calculated through formula (2), and the average thereof is determined to obtain SF1.

The volume average particle size of the toner of the exemplary embodiment is preferable in a range of from 8 μm to 15 μm (or from about 8 μm to about 15 μm), more preferably in a range of from 9 μm to 14 μm, and still more preferably in a range of from 10 μm to 12 μm. If the volume average particle size is in the above range, a color gamut is retained while glossiness is retained, and by controlling the surface area of the toner, the amount of the C.I. Pigment Red 57:1 on the toner surface is suppressed. Accordingly, the aggregation of the C.I. Pigment Red 57:1 in the fixed image in fixing is suppressed, whereby the deterioration of the blue image reproducibility is further suppressed.

The volume average particle size is measured using a Coulter multisizer (manufactured by Beckman Coulter, Inc) at an aperture diameter of 50 μm. At this time, the particle size is measured after the toner is dispersed in an aqueous electrolyte solution (aqueous isotonic solution) and further dispersed for at least 30 seconds by ultrasonic waves.

The glass transition temperature (Tg) of the toner of the exemplary embodiment is preferably from 35° C. to 50° C. (or from about 35° C. to about 50° C.). If the glass transition temperature (Tg) of the toner is in the above range, the toners are suppressed from being aggregated with each other in a developer unit, dripping during developing is suppressed, and the toner is uniformly molten during fixing. Therefore, the aggregation of the C.I. Pigment Red 57:1 is suppressed even in the fixed image, so the deterioration of the blue image reproducibility is further suppressed.

It is more preferable that the glass transition temperature (Tg) of the toner be in a range of from 40° C. to 50° C.

The glass transition temperature (Tg) is a value obtained by a measurement based on JIS 7121-1987, which is performed using a differential scanning calorimetry (manufactured by Mac Science Inc.: DSC 3110, thermal analysis system 001). To correct the temperature of a detection portion of the device, a melting point of a mixture of indium and zinc is used, and to correct calorie, heat of fusion of indium is used. A sample (toner) is put in a pan made of aluminum, and the pan made of aluminum in which the sample is put and an empty aluminum pan for control are set, followed by the measurement at a rate of temperature rise of 10° C./min. A temperature at an intersection point of extensions of a base line and a rising line in an endothermic portion of the DSC curve which is obtained by the measurement is taken as the glass transition temperature.

<Method for Preparing Toner>

A method for preparing the toner of the exemplary embodiment is not particularly limited. The toner particles are prepared by well-known dry methods such as kneading with pulverizing, and wet methods such as emulsion aggregation and suspension polymerization, and external additives are further added optionally to the toner particles. Among these methods, kneading with pulverizing is preferable.

In the kneading with pulverizing, a toner forming material containing the colorants and the binder resin is kneaded to obtain a kneaded material, and then the kneaded material is pulverized, whereby the toner particles are prepared. Obtaining the toner by preparing the toner particles through the kneading with pulverizing leads to the preparation of the toner in which the C.I. Pigment Red 57:1 is excellently and stably dispersed, and as a result, the deterioration of the blue image reproducibility is further suppressed.

In more detail, the kneading with pulverizing is divided into kneading the toner forming material containing the colorants and the binder resin, and pulverizing the kneaded material. Other processes such as cooling the kneaded material formed by the kneading may be optionally added.

Each process will be described in detail.

—Kneading—

In kneading, the toner forming material containing the colorants and the binder resin is kneaded.

In the kneading, it is preferable to add from 0.5 part by mass to 5 parts by mass of an aqueous medium (for example, water such as distilled water and ion exchange water, alcohols, and the like), based on 100 parts by mass of the toner forming material.

Examples of a kneader used for kneading include a uniaxial extruder and a biaxial extruder. Hereinafter, as an example of the kneader, a kneader including a feed screw and two kneading portions will be described using a drawing, but the kneader is not limited thereto.

FIG. 1 is a view illustrating a state of a screw of an exemplary screw extruder used for kneading in the method of preparing the toner of the exemplary embodiment.

A screw extruder 11 is configured with a barrel 12 including a screw (not shown), an inlet 14 through which the toner forming material as a raw material of the toner is injected to the barrel 12, a liquid addition port 16 for adding an aqueous medium to the toner forming material in the barrel 12, and a discharge port 18 for discharging the kneaded material formed when the toner forming material is kneaded in the barrel 12.

The barrel 12 is divided into, in the following order from the portion close to the inlet 14, a feed screw portion SA feeding the toner forming material injected from the inlet 14 to a kneading portion NA, the kneading portion NA for melting and kneading the toner forming material by a first kneading, a feed screw portion SB feeding the toner forming material which has been molten and kneaded in the kneading portion NA to a kneading portion NB, the kneading portion NB forming a kneaded material by melting and kneading the toner forming material through a second kneading, and a feed screw portion SC feeding the formed kneaded material to the discharge port 18.

Inside the barrel 12, each block is provided with a different temperature control unit (not shown). That is, each of the blocks 12A to 12J has a configuration in which the blocks may be controlled to different temperatures. FIG. 1 illustrates a state where the temperature of blocks 12A and 12B is controlled to t0° C., the temperature of blocks 12C to 12E is controlled to t1° C., and the temperature of blocks 12F to 12J is controlled to t2° C. respectively. Accordingly, the toner forming material in the kneading portion NA is heated to t1° C., and the toner forming material in the kneading portion NB is heated to t2° C.

When the toner forming material containing the binder resin, the colorants, and, optionally, the release agent and the like are supplied to the barrel 12 from the inlet 14, the toner forming material is fed to the kneading portion NA by the feed screw portion SA. At this time, since the temperature of the block 12C has been set to t1° C., the toner forming material is fed into the kneading portion NA while having been molten by heating. Moreover, since the temperature of the blocks 12D and 12E has also been set to t1° C., the toner forming material is molten and kneaded at t1° C. in the kneading portion NA. The binder resin and the release agent are molten in the kneading portion NA and sheared by the screw.

Subsequently, the toner forming material having been kneaded in the kneading portion NA is fed to the kneading portion NB by the feed screw portion SB.

Thereafter, an aqueous medium is injected to the barrel 12 through the liquid addition port 16 in the feed screw portion SB, whereby the aqueous medium is added to the toner forming material. FIG. 1 illustrates an exemplary embodiment of injecting the aqueous medium in the feed screw portion SB, but the exemplary embodiment is not limited thereto. The aqueous medium may be injected in the kneading portion NB and may be injected in both the feed screw portion SB and the kneading portion NB. That is, the injection position and injection site of the aqueous medium is selected optionally.

As described above, when the aqueous medium is injected to the barrel 12 from the liquid addition port 16, the toner forming material in the barrel 12 is mixed with the aqueous medium, and the toner forming material is cooled by latent heat of evaporation of the aqueous medium, whereby the temperature of the toner forming material is properly retained.

Finally, the kneaded material formed by being molten and kneaded in the kneading portion NB is fed to the discharge port 18 by the feed screw portion SC, and is discharged from the discharge port 18.

In this manner, the kneading using the screw extruder 11 shown in FIG. 1 is performed.

—Cooling—

Cooling is performed to cool the kneaded material formed in the kneading. During the cooling, it is preferable to cool the temperature from the temperature of the kneaded material at the end of the kneading to 40° C. or lower at an average temperature decrease rate of 4° C./sec or higher. If the cooling rate of the kneaded material is slow, a mixture (a mixture of colorants and internal additives such as a release agent which is optionally added inside the toner particles) finely dispersed in the binder resin in the kneading is recrystallized, so a dispersion diameter increases in some cases. On the other hand, if the kneaded material is rapidly cooled at the above average temperature decrease rate, the dispersed state of the material right after the end of the kneading is retained as it is, which thus is preferable. The average temperature decrease rate refers to the average of the rate at which the temperature is decreased from the temperature (for example, t2° C. when the screw extruder 11 shown in FIG. 1 is used) of the kneaded material at the end of the kneading to 40° C.

Specific example of a cooling method in the cooling includes a method that uses a rolling roll in which cold water or brine has been circulated and an insertion type cooling belt. When the cooling is performed by the above method, the cooling rate is determined by the speed of the rolling roll, the amount of the brine flowing, the amount of the kneaded material supplied, the slab thickness of the kneaded material during rolling, and the like. The slab thickness is preferably from 1 mm to 3 mm.

—Pulverizing—

The kneaded material having been cooled by the cooling is pulverized by pulverizing, whereby particles are formed. In the pulverizing, a mechanical pulverizer, a jet mill or the like is used, for example.

—Classification—

In order to obtain toner particles having a volume average particle size in a target range, the particles obtained by the pulverizing may be optionally classified by classification. In the classification, a centrifugal classifier, an inertial classifier or the like which has been used in the related art is used to remove fine powder (particles smaller than a particle size in a target range) and coarse powder (particles bigger than a particle size in a target range).

—External Addition—

For the purpose of charge adjustment, imparting fluidity and electric charge exchange property, and the like, inorganic particles represented by the above-described specific silica, titania, and aluminum oxide may be added and attached to the obtained toner particles. The inorganic particles are attached by, for example, a V-shaped blender, a Henschel mixer, and a Lodige mixer in divided stages.

—Sieving—

Sieving may be optionally performed after the addition of external additives. Examples of a sieving method include methods that use a Gyro-shifter, a vibration sieving machine, an air classifier machine, and the like. The coarse powder or the like of the external additives is removed by the sieving, and as a result, the occurrence of streaks on the photoreceptor, contamination caused by dripping in the device, and the like are suppressed.

<Developer>

The developer of the exemplary embodiment includes at least the toner of the exemplary embodiment.

The toner of the exemplary embodiment is used as a single component developer as it is, or as a two-component developer. When being used as the two-component developer, the toner is used by being mixed with a carrier.

As the carrier being able to be used for the two-component developer, well-known carriers may be used without any limitation. Examples of the carrier include magnetic metals such as an iron oxide, nickel, and cobalt; magnetic oxides such as ferrite and magnetite; resin-coated carriers including a resin-coated layer on the surface of the core thereof; and magnetic dispersed type carriers. In addition, the carrier may be a resin dispersed type carrier in which a conductive material or the like is dispersed in a matrix resin.

In the two-component developer, the mixing ratio (mass ratio) between the toner and the carrier is preferably in a range of about toner:carrier=1:100 to 30:100, and more preferably in a range of about 3:100 to 20:100.

<Image Forming Apparatus and Image Forming Method>

Next, the image forming apparatus of the exemplary embodiment using the developer of the exemplary embodiment will be described.

The image forming apparatus of the exemplary embodiment includes a latent image holding member, a charging unit that charges the surface of the latent image holding member, an electrostatic latent image forming unit that forms an electrostatic latent image on the surface of the latent image holding member, a developing unit that develops the electrostatic latent image by using the developer of the exemplary embodiment to form a toner image, a transfer unit that transfers the toner image to a recording medium, and a fixing unit that fixes the toner image to the recording medium.

In the image forming apparatus, for example, the portion including the developing unit may have a cartridge structure (process cartridge) being detachable from the body of the image forming apparatus. As the process cartridge, the process cartridge of the exemplary embodiment which contains the developer of the exemplary embodiment, includes a developing unit developing the electrostatic latent image formed on the surface of the latent image holding member by using the developer to form a toner image, and is detachable from the image forming apparatus is suitably used.

Hereinafter, an example of the image forming apparatus of the exemplary embodiment will be illustrated, but the exemplary embodiment is not limited thereto. The description will be made focusing on a principally used portion shown in the drawing, and descriptions of other portions will be omitted.

Figure 2:
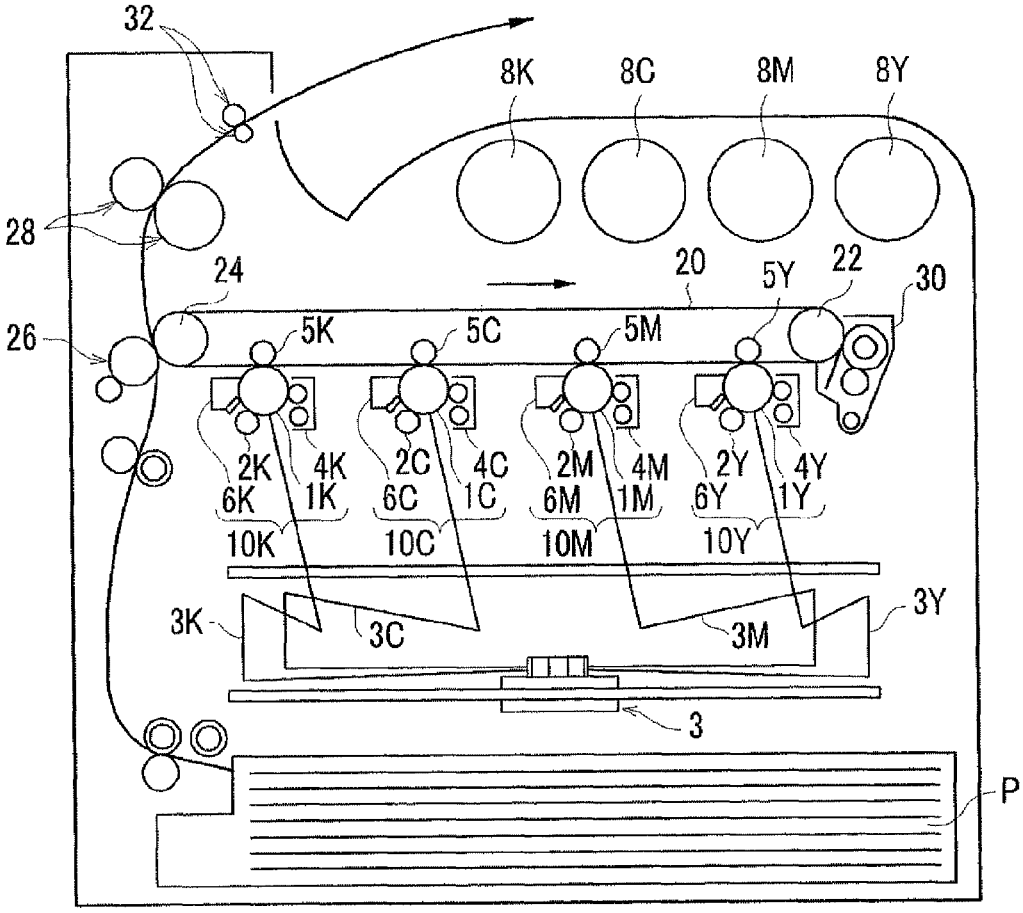
FIG. 2 is a schematic configurational view illustrating an example of an image forming apparatus according to the exemplary embodiment.

FIG. 2 is a schematic configurational view illustrating an example of a 4-drum tandem system of color image forming apparatus. The image forming apparatus shown in FIG. 2 includes a first to fourth image forming units 10Y, 10M, 10C, and 10K which employ an electrophotography system in which images of each color including yellow (Y), magenta (M), cyan (C), and black (K) based on image data separated for each color are output. These image forming units (hereinafter, simply referred to as "units" in some cases) 10Y, 10M, 100, and 10K are arranged in parallel while separating from each other at preset intervals in a horizontal direction. The units 10Y, 10M, 10C, and 10K may be process cartridges being able to be detachable from the body of the image forming apparatus.

On each of 10Y, 10M, 10C, and 10K in the drawing, an intermediate transfer belt 20 extends as an intermediate transfer member passing through each unit. The intermediate transfer belt 20 is provided while being wound around a driving roller 22 and a supporting roller 24 which contact the inner surface of the intermediate transfer belt 20, and drives in a direction heading from the first unit 10Y to the fourth unit 10K. The supporting roller 24 is biased by a spring (not shown) or the like in a direction separating from the driving roller 22, and a preset tension is applied to the intermediate transfer belt 20 wound around the both rollers. At the surface of the intermediate transfer belt 20 facing the latent image holding member, an intermediate transfer member cleaning device 30 is provided facing the driving roller 22.

The toners of 4 colors including yellow, magenta, cyan, and black accommodated in toner cartridges 8Y, 8M, 8C, and 8K are suppliable to each of developing devices (developing units) 4Y, 4M, 4C, and 4K of each of the units 10Y, 10M, 100, and 10K.

The first to fourth units 10Y, 10M, 100, and 10K have the same configuration. Therefore, herein, the first unit 10Y which is arranged at the upstream side in the rotating direction of the intermediate transfer belt and forms yellow images will be representatively described. In addition, the same portions as that of the first unit 10Y are marked with reference numerals indicating magenta (M), cyan (C), and black (K) instead of yellow (Y), whereby the description for the second to fourth units 10M, 10C, and 10K will be omitted.

The first unit 10Y includes a photoreceptor 1Y working as a latent image holding member. Around the photoreceptor 1Y, a charging roller 2Y charging the surface of the photoreceptor 1Y with a preset potential, an exposure device 3 exposing the charged surface with a laser beam 3Y based on image signals separated for each color to form an electrostatic latent image, a developing device (developing unit) 4Y developing the electrostatic latent image by supplying the charged toner to the electrostatic latent image, a primary transfer roller (primary transfer unit) 5Y transferring the developed toner image to the intermediate transfer belt 20, and a photoreceptor cleaning device (cleaning unit) 6Y removing residual toner on the surface of the photoreceptor 1Y after the primary transfer are arranged in an order.

The primary transfer roller 5Y is arranged inside the intermediate transfer belt 20 at a position facing the photoreceptor 1Y. Each of the primary transfer rollers 5Y, 5M, 5C, and 5K is respectively connected to a bias power source (not shown) applying primary transfer bias. Each bias power source is controlled by a control portion (not shown), thereby varying transfer bias to be applied to each of the primary transfer rollers.

Hereinafter, an operation of forming a yellow image in the first unit 10Y will be described. First, prior to this operation, the surface of the photoreceptor 1Y is charged by the charging roller 2Y with a potential of from about −600 V to about −800 V.

The photoreceptor 1Y is formed with laminated photosensitive layers on a conductive (volume resistivity at 20° C.: $1\times10^{-6}$ Ωcm or less) substrate. The photosensitive layers show high resistivity (resistivity approximately similar to that of the general resin) in general. However, when irradiated with the laser beam 3Y, the layers show a characteristic in which the specific resistivity of the portion irradiated with the laser beam changes. Therefore, according to image data for yellow transmitted from the control portion (not shown), the laser beam 3Y is output to the surface of the charged photoreceptor 1Y through the exposure device 3. The laser beam 3Y is emitted to the photosensitive layer on the surface of the photoreceptor 1Y, and as a result, an electrostatic latent image of a yellow printing pattern is formed on the surface of the photoreceptor 1Y.

The electrostatic latent image is an image formed on the surface of the photoreceptor 1Y by charging, and is a so-called negative latent image which is formed in a manner in which the specific resistivity of the portion irradiated with the laser beam 3Y of the photosensitive layer is lowered, and electric charge charging the surface of the photoreceptor 1Y flows while the electric charge in the portion not irradiated with the laser beam 3Y remains.

The electrostatic latent image formed on the photoreceptor 1Y in this manner is rotated to a preset developing position according to driving of the photoreceptor 1Y. In the developing position, the electrostatic latent image on the photoreceptor 1Y is made into a visible image (developed image) by the developing device 4Y.

The yellow developer contained in the developing device 4Y is agitated in the developing device 4Y so as to be charged triboelectrically, includes electric charge of the same polarity (negative polarity) as the electric charge charging the photoreceptor 1Y, and is held on a developer roller (developer holder). When the surface of the photoreceptor 1Y passes through the developing device 4Y, the yellow toner is electrostatically attached to the erased latent image portion on the surface of the photoreceptor 1Y, whereby the latent image is developed by the yellow toner. The photoreceptor 1Y where the yellow toner image has been formed drives subsequently at a preset speed, and the toner image developed on the photoreceptor 1Y is transported to a preset primary transfer position.

When the yellow toner image on the photoreceptor 1Y is transported to the primary transfer position, a preset primary transfer bias is applied to the primary transfer roller 5Y, and an electrostatic force heading from the photoreceptor 1Y to the primary transfer roller 5Y acts on the toner image, whereby the toner image on the photoreceptor 1Y is transferred to the intermediate transfer belt 20. The polarity of the transfer bias applied at this time is positive, which is a reverse polarity of the negative polarity of the toner, and for example, the bias is controlled in the first unit 10Y by the control portion (not shown) to about +10 μA.

Meanwhile, the residual toner on the photoreceptor 1Y is removed by the cleaning device 6Y and is collected.

The primary transfer bias applied to the primary transfer rollers 5M, 5C, and 5K arranged in and beyond the second unit 10M is also controlled based on the first units.

In this manner, the intermediate transfer belt 20 to which the yellow toner image has been transferred through the first unit 10Y is sequentially transported through the second to fourth units 10M, 10C, and 10K, and toner images of each color are superimposed on each other, whereby a superimposed toner image is formed.

The intermediate transfer belt 20 on which the toner images of four colors have been superimposed through the first to fourth units reaches a secondary transfer portion configured with the intermediate transfer belt 20, the supporting roller 24 contacting the inner surface of the intermediate transfer belt 20, and a secondary transfer roller (secondary transfer unit) 26 arranged at the image holding surface of the intermediate transfer belt 20. Meanwhile, recording paper (recording medium) P is fed through a feeding mechanism at a preset timing to a gap between the secondary transfer roller 26 and the intermediate transfer belt 20 being in pressure contact with each other, and a preset secondary transfer bias is applied to the supporting roller 24. The polarity of the transfer bias applied at this time is negative, which is the same polarity as the negative polarity of the toner, and the electrostatic force heading from the intermediate transfer belt 20 to the recording paper P acts on the superimposed toner image, whereby the superimposed toner image on the intermediate transfer belt 20 is transferred onto the recording paper P. At this time, the secondary transfer bias is determined according to resistance detected by a resistance detection unit (not shown) that detects the resistance of the secondary transfer portion, and is voltage-controlled.

Thereafter, the recording paper P is fed into a fixing device (fixing unit) 28, the superimposed toner image is heated, and the toner image formed with superimposed colors is fused and fixed onto the recording paper P. The recording paper P in which the color image fixing has been completed is transported toward a discharge portion by a feed roller (discharge roller) 32, whereby a series of operations for forming a color image ends.

The image forming apparatus exemplified above has a configuration in which the superimposed toner image is transferred to the recording paper P through the intermediate transfer belt 20. However, the apparatus is not limited to this configuration, and a configuration in which the toner image is directly transferred to the recording paper from the photoreceptor may be employed.

According to the color image forming apparatus shown in FIG. 2, an image forming method including developing an electrostatic latent image using plural types of toners to form plural toner images by the plural types of toners, transferring the plural toner images by superimposing the images on the surface of a recording medium to form a superimposed toner image formed of plural layers, and fixing the superimposed toner image to form an image is performed. In this case, by using the toner of the exemplary embodiment as a magenta toner, and by using a cyan toner including a phthalocyanine-based pigment as a colorant as a cyan toner, the image forming method of the exemplary embodiment is performed.

<Process Cartridge and Toner Cartridge>

Figure 3:
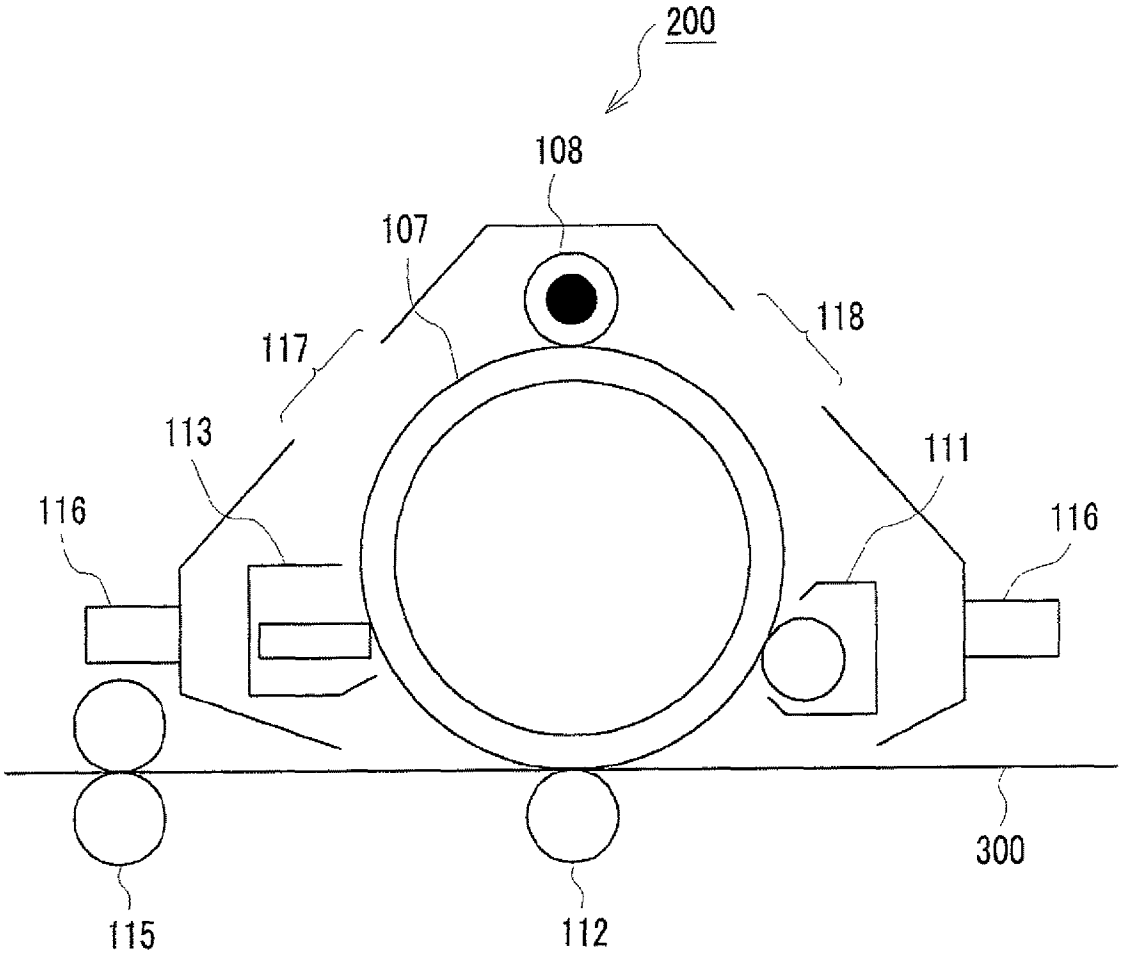
FIG. 3 is a schematic configurational view illustrating an example of a process cartridge according to the exemplary embodiment.

FIG. 3 is a schematic configurational view illustrating a suitable example of a process cartridge containing the developer of the exemplary embodiment. A process cartridge 200 is configured with a photoreceptor 107, a charging roller 108, a developing device 111, a photoreceptor cleaning device (cleaning unit) 113, an opening portion 118 for exposure, and an opening portion 117 for erasing exposure, which are combined by a rail 116 and then integrated.

The process cartridge 200 is freely detachable from the body of the image forming apparatus configured with a transfer device 112, a fixing device 115, and other configurational portions (not shown), and configures the image forming apparatus together with the body of the image forming apparatus. In addition, 300 indicates the recording paper.

The process cartridge 200 shown in FIG. 3 includes the photoreceptor 107, a charging roller 108, the developing device 111, the cleaning device 113, the opening portion 118 for exposure, and the opening portion 117 for erasing exposure. However, these devices may be selectively combined. The process cartridge of the exemplary embodiment may include at least one kind selected from a group consisting of the photoreceptor 107, the charging roller 108, the cleaning device (cleaning unit) 113, the opening portion 118 for exposure, and the opening portion 117 for erasing exposure, in addition to the developing device 111.

Next, the toner cartridge will be described.

The toner cartridge is mounted on the image forming apparatus so as to be freely detachable from the image forming apparatus. In the toner cartridge accommodating a toner to be supplied to the developing unit provided in the image forming apparatus, the toner is at least the toner of the exemplary embodiment described above. The toner cartridge may accommodate at least a toner, and depending on the mechanism of the image forming apparatus, the cartridge may accommodate a developer, for example.

The image forming apparatus shown in FIG. 2 is an image forming apparatus having a configuration in which toner cartridges 8Y, 8M, 8C, and 8K are detachable from the image forming apparatus. The developing devices 4Y, 4M, 4C, and 4K are connected to the toner cartridges corresponding to each of the developing devices (colors) through developer supplying tubes (not shown). When the developer stored in each toner cartridge is decreased, it is possible to replace the toner cartridge.

EXAMPLES

Hereinafter, the exemplary embodiment will be described in more detail by using examples and comparative examples, but the exemplary embodiment is not limited to the following examples. In addition, unless otherwise specified, "part" and "%" are based on mass.

(Binder Resin 1-1 Synthesis)

| | |
|---|---|
| Oxymethane(1.1)-2,2-bis(4-hydroxyphenyl)propane | 40 parts |
| Ethylene glycol | 10 parts |
| Terephthalic acid | 45 parts |
| Fumaric acid | 5 parts |

The above components are put into a round-bottom flask including a stirrer, a nitrogen introducing tube, a temperature sensor, and a rectifier, and the temperature is raised up to 200° C. by using a mantle heater. Subsequently, nitrogen gas is introduced thereto through a gas introducing tube, followed by stirring while the inside of the flask is kept under an inert gas atmosphere. Thereafter, 0.05 part of dibutyltin oxide based on 100 parts of the raw material mixture is added thereto, and the reactant is allowed to react for 12 hours while the temperature thereof is kept at 200° C., thereby obtaining a binder resin 1-1.

Tg of the obtained resin measured by DSC is 44° C.

(Binder Resin 1-2 Synthesis)

A binder resin 1-2 is obtained by the same composition and the same synthesis method as that of the binder resin 1-1 except that oxymethane(1.1)-2,2-bis(4-hydroxyphenyl)propane is changed to polyoxyethylene(1.2)-2,2-bis(4-hydroxyphenyl)propane. Tg of the obtained resin measured by DSC is 44° C.

(Binder Resin 1-3 Synthesis)

A binder resin 1-3 is obtained by the same composition and the same synthesis method as that of the binder resin 1-1 except that oxymethane(1.1)-2,2-bis(4-hydroxyphenyl)propane is changed to polyoxypropylene(1.3)-2,2-bis(4-hydroxyphenyl)propane. Tg of the obtained resin measured by DSC is 44° C.

(Binder Resin 1-4 Synthesis)

A binder resin 1-4 is obtained by the same composition and the same synthesis method as that of the binder resin 1-1 except that oxymethane(1.1)-2,2-bis(4-hydroxyphenyl)propane is changed to polyoxybutylene(1.4)-2,2-bis(4-hydroxyphenyl)propane. Tg of the obtained resin measured by DSC is 44° C.

(Binder Resin 1-5 Synthesis)

A binder resin 1-5 is obtained by the same composition and the same synthesis method as that of the binder resin 1-1 except that oxymethane(1.1)-2,2-bis(4-hydroxyphenyl)propane is changed to polyoxypentene (1.5)-2,2-bis(4-hydroxyphenyl) propane. Tg of the obtained resin measured by DSC is 44° C.

(Binder Resin 2 Synthesis)

A binder resin 2 is obtained by the same composition and the same synthesis method as that of the binder resin 1-3, except that 35 parts of terephthalic acid and 15 parts of fumaric acid are used. Tg of the obtained resin measured by DSC is 34° C.

(Binder Resin 3 Synthesis)

A binder resin 3 is obtained by the same composition and the same synthesis method as that of the binder resin 1-3, except that 36 parts of terephthalic acid and 14 parts of fumaric acid are used. Tg of the obtained resin measured by DSC is 35° C.

(Binder Resin 4 Synthesis)

A binder resin 4 is obtained by the same composition and the same synthesis method as that of the binder resin 1-3, except that 37 parts of terephthalic acid and 13 parts of fumaric acid are used. Tg of the obtained resin measured by DSC is 36° C.

(Binder Resin 5 Synthesis)

A binder resin 5 is obtained by the same composition and the same synthesis method as that of the binder resin 1-3, except that 41 parts of terephthalic acid and 9 parts of fumaric acid are used. Tg of the obtained resin measured by DSC is 40° C.

(Binder Resin 6 Synthesis)

A binder resin 6 is obtained by the same composition and the same synthesis method as that of the binder resin 1-3, except that 49 parts of terephthalic acid and 1 part of fumaric acid are used. Tg of the obtained resin measured by DSC is 48° C.

(Binder Resin 7 Synthesis)

A binder resin 7 is obtained by the same composition and the same synthesis method as that of the binder resin 1-3, except that 41 parts of polyoxypropylene(1.3)-2,2-bis(4-hydroxyphenyl)propane and 9 parts of ethylene glycol are used. Tg of the obtained resin measured by DSC is 51° C.

(Preparation of Toner 1)

Binder resin 1-3: 1760 parts

Release agent (polypropylene; manufactured by Mitsui Chemicals, Inc., Mitsui HI-WAX NP055): 100 parts C.I. Pigment Red 57:1 (manufactured by Dainichiseika Color & Chemicals Mfg. Co., Ltd., Seikafast PR-57-1): 99.55 parts C.I. Pigment Yellow 180 (manufactured by Clariant, Novoperm Yellow P-H9): 0.05 part silica (manufactured by NIPPON AEROSIL CO., Ltd. OX-50, number average particle size: 54 nm):20 parts Rosin (manufactured by Harima Chemicals, Inc., Hartal 1 RX): 20 parts The above components are subjected to raw material blending by using a 75 L Henschel mixer, followed by kneading by using a continuous kneader (biaxial extruder) having the screw configuration shown in FIG. 1 under the following condition. The number of rotation of the screw is 500 rpm.

Set temperature of feed portion (blocks 12A to 12B) 20° C.

Set temperature for kneading in kneading portion 1 (blocks 12C to 12E) 120° C.

Set temperature for kneading in kneading portion 2 (blocks 12F to 12J) 135° C.

Amount of aqueous medium (distilled water) added:

1.5 parts based on 100 parts of supplied raw materials

At this time, the temperature of the kneaded material measured at the discharge port (discharge port 18) is 125° C.

The kneaded material is rapidly cooled by a rolling roll in which −5° C. brine has passed and a slab insertion type cooling belt having been cooled with 2° C. cold water, and then ground by a hammer mill after being cooled. The rate of the rapid cooling is confirmed while the speed of the cooling belt is varied, and the average temperature decrease rate is 10° C./sec.

Subsequently, the resultant is pulverized by a pulverizer (AFG 400) including a built-in coarse powder classifier, thereby obtaining pulverized particles. Thereafter, the particles are classified by an inertial classifier, and fine powder and coarse powder are removed, thereby toner particles 1 are obtained.

The shape coefficient SF1 of the obtained toner particles 1 is 150.

To 100 parts of the obtained toner particles 1, 1.0 part of silica (manufactured by NIPPON AEROSIL CO., Ltd. silica obtained by treating MOX with isobutyltrimethoxysilane, number average particle size: 30 nm) and 0.5 part of silica (manufactured by NIPPON AEROSIL CO., Ltd. R972, number average particle size: 16 nm) are added, followed by mixing for 3 minutes by using a Henschel mixer (speed of the leading end of the rotation blade of 22 m/s), thereby obtaining a toner 1. The shape coefficient SF1 of the toner 1 is the same as the shape coefficient of the toner particles 1.

The toner 1 is dissolved in toluene, followed by extraction of the insoluble portion, whereby a ratio of PR 57:1 amount/PY 180 amount is confirmed to be 1991 from IR and fluorescent X-ray analyses, and an NMR analysis.

(Preparation of Toner 2)

A toner 2 is obtained in the same manner as in the preparation of the toner 1 except that the binder resin 1-4 is used instead of the binder resin 1-3.

(Preparation of Toner 3)

A toner 3 is obtained in the same manner as in the preparation of the toner 1 except that the binder resin 1-2 is used instead of the binder resin 1-3.

(Preparation of Toner 4)

A toner 4 is obtained in the same manner as in the preparation of the toner 1 except that the content of the C.I. Pigment Yellow 180 is set to 0.01016 part.

(Preparation of Toner 5)

A toner 5 is obtained in the same manner as in the preparation of the toner 1 except that the content of the C.I. Pigment Red 57:1 is set to 100 parts and that the content of the C.I. Pigment Yellow 180 is set to 1 part.

(Preparation of Toner 6)

A toner 6 is obtained in the same manner as in the preparation of the toner 1 except that the content of the C.I. Pigment Red 57:1 is set to 99.99 parts.

(Preparation of Toner 7)

A toner 7 is obtained in the same manner as in the preparation of the toner 1 except that the content of the C.I. Pigment Red 57:1 is set to 99.01 parts.

(Preparation of Toner 8)

A toner 8 is obtained in the same manner as in the preparation of the toner 1 except that the content of the C.I. Pigment Yellow 180 is set to 0.9 part.

(Preparation of Toner 9)

A toner 9 is obtained in the same manner as in the preparation of the toner 1 except that the content of the C.I. Pigment Yellow 180 is set to 0.012 part.

(Preparation of Toners 10 to 17)

Toners 10 to 17 are obtained in the same manner as in the preparation of the toner 1 except that the pulverizing condition of the pulverizer and the classifying condition of the inertial classifier are adjusted.

(Preparation of Toner 18)

A toner 18 is obtained in the same manner as in the preparation of the toner 1 except that polyethylene (manufactured by Sanyo Chemical Industries, Ltd., Sunwax 151p) is used as a release agent, instead of polypropylene.

(Preparation of Toner 19)

A toner 19 is obtained in the same manner as in the preparation of the toner 1 except that Fischer-Tropsch wax (manufactured by NIPPON SEIRO Co., LTD., FNP 0092) is used as a release agent, instead of polypropylene.

(Preparation of Toner 20)

A toner 20 is obtained in the same manner as in the preparation of the toner 1 except that polyester (manufactured by NOF CORPORATION, WEP 5) is used as a release agent, instead of polypropylene.

(Preparation of Toner 21)

A toner 21 is obtained in the same manner as in the preparation of the toner 1 except that carnauba wax (manufactured by S. KATO & CO., carnauba wax no. 1) is used as a release agent, instead of polypropylene.

(Preparation of Toner 22)

A toner 22 is obtained in the same manner as in the preparation of the toner 1 except that the binder resin 2 is used instead of the binder resin 1-3.

(Preparation of Toner 23)

A toner 23 is obtained in the same manner as in the preparation of the toner 1 except that the binder resin 3 is used instead of the binder resin 1-3.

(Preparation of Toner 24)

A toner 24 is obtained in the same manner as in the preparation of the toner 1 except that the binder resin 4 is used instead of the binder resin 1-3.

(Preparation of Toner 25)

A toner 25 is obtained in the same manner as in the preparation of the toner 1 except that the binder resin 5 is used instead of the binder resin 1-3.

(Preparation of Toner 26)

A toner 26 is obtained in the same manner as in the preparation of the toner 1 except that the binder resin 6 is used instead of the binder resin 1-3.

(Preparation of Toner 27)

A toner 27 is obtained in the same manner as in the preparation of the toner 1 except that the binder resin 7 is used instead of the binder resin 1-3.

(Preparation of Toner 28)

A toner 28 is obtained in the same manner as in the preparation of the toner 1 except that the binder resin 1-5 is used instead of the binder resin 1-3.

(Preparation of Toner 29)

A toner 29 is obtained in the same manner as in the preparation of the toner 1 except that the binder resin 1-1 is used instead of the binder resin 1-3.

(Preparation of Toner 30)

A toner 30 is obtained in the same manner as in the preparation of the toner 1 except that the content of the C.I. Pigment Red 57:1 is set to 98.5 parts and the content of the C.I. Pigment Yellow 180 is set to 1.15 parts.

(Preparation of Toner 31)

A toner 31 is obtained in the same manner as in the preparation of the toner 1 except that the content of the C.I. Pigment Red 57:1 is set to 99.1 parts and the content of the C.I. Pigment Yellow 180 is set to 0.009 part.

(Preparation of Toner 32)

A toner 32 is obtained in the same manner as in the preparation of the toner 1 except that C.I. pigment red 238 (PR 238; manufactured by Dainichiseika Color & Chemicals Mfg. Co., Ltd, Permanent Carmine 3810) is used instead of the C.I. Pigment Red 57:1.

(Preparation of Toner 33)

A toner 33 is obtained in the same manner as in the preparation of the toner 1 except that C.I. Pigment Yellow 74 (PY 74; manufactured by Clariant, Hansa Yellow 5GX01) is used instead of the C.I. Pigment Yellow 180.

(Preparation of Toner 34)

A toner 34 is obtained in the same manner as in the preparation of the toner 1 except that PR 238 and PY 74 are used instead of the C.I. Pigment Red 57:1 and C.I. Pigment Yellow 180 respectively.

(Preparation of Cyan Toner)

A cyan toner is obtained in the same manner as in the preparation of the toner 1 except that 100 parts of a phthalocyanine-based pigment (C.I. pigment blue 15:3, manufactured by Dainichiseika Color & Chemicals Mfg. Co., Ltd.) is used as a colorant.

<Preparation of Carrier>

1,000 parts of Mn—Mg ferrite (average particle size of 50 μm: manufactured by Powdertech) is introduced into a kneader, and a solution obtained by dissolving 150 parts of a styrene-methyl methacrylate-acrylic acid copolymer (polymerization ratio of 39:60:1 (molar ratio), Tg of 100° C., weight average molecular weight of 73,000: manufactured by Soken Chemical & Engineering Co., Ltd.) in 700 parts of toluene is added thereto, followed by mixing at 25° C. for 20 minutes. Thereafter, the resultant is dried under reduced pressure by being heated at 70° C. and then taken out, thereby obtaining a coat carrier. The obtained coat carrier is sieved through a mesh having 75 μm openings to remove coarse powder, thereby obtaining a carrier 1.

<Preparation of Developer>

The carrier 1 with the toners 1 to 34 or the cyan toner are respectively introduced into a V blender in a mass ratio of 95:5, followed by stirring for 20 minutes, thereby obtaining the magenta developers 1 to 34 and the cyan developer.

<Evaluation>

ApeosPort-C4300 manufactured by Fuji Xerox Co., Ltd is filled with the magenta developers 1 to 34 and the cyan developer. Using a Japan color 2007 (JCS 2007) test form 2 (pattern) for sheet-fed printing, an image is formed on coated paper (127.9 g/m$^3$). Image quality obtained after 1000 times of repeated copying is compared with initial (image quality obtained from the first copy) image quality, whereby the blue reproducibility is visually checked. To evaluate the blue reproducibility, the color of the blue clothes of a person at the center in a picture of musicians (three girls) is evaluated based on the following criteria.

—Blue Reproducibility Determination Criteria—

A: The same level compared to the initial image quality

B: A level showing slight difference compared to the initial image quality, but no uncomfortable feeling C: A level showing difference compared to the initial image quality, but no uncomfortable feeling D: A level showing obvious difference and giving uncomfortable feeling compared to the initial image quality The obtained results are shown in Tables 1 and 2 along with values of n and m in the repeating unit derived from bisphenol A ethylene oxide represented by formula (1) contained in the binder resin, the contents of the C.I. Pigment Yellow 180 (PY 180) and the C.I. Pigment Red 57:1, the mass ratio (PR 57:1 amount/PY 180 amount) between the C.I. Pigment Red 57:1 and the C.I. Pigment Yellow 180, the volume average particle size of the toner, SF1 of the toner, the type of the release agent and the binder resin, and the glass transition temperature of the toner.

TABLE 1

| | Toner | Value of m and n in formula (1) | PR 57:1 pigment amount part | PY 180 pigment amount part | PR 57:1 amount/ PY 180 amount | Volume average particle size μm | SF1 | Release agent | Binder resin | Glass transition temperature | Blue reproducibility |
|---|---|---|---|---|---|---|---|---|---|---|---|
| Example 1 | 1 | 3 | 99.55 | 0.05 | 1991 | 10 | 150 | Polypropylene | 1-3 | 44° C. | A |
| Example 2 | 2 | 4 | 99.55 | 0.05 | 1991 | 10 | 150 | Polypropylene | 1-4 | 44° C. | A |
| Example 3 | 3 | 2 | 99.55 | 0.05 | 1991 | 10 | 150 | Polypropylene | 1-2 | 44° C. | A |
| Example 4 | 4 | 3 | 99.55 | 0.01016 | 9798 | 10 | 150 | Polypropylene | 1-3 | 44° C. | A |
| Example 5 | 5 | 3 | 100 | 1 | 100 | 10 | 150 | Polypropylene | 1-3 | 44° C. | A |
| Example 6 | 6 | 3 | 99.99 | 0.05 | 1999.8 | 10 | 150 | Polypropylene | 1-3 | 44° C. | A |
| Example 7 | 7 | 3 | 99.01 | 0.05 | 1980.2 | 10 | 150 | Polypropylene | 1-3 | 44° C. | A |
| Example 8 | 8 | 3 | 99.55 | 0.9 | 110.61 | 10 | 150 | Polypropylene | 1-3 | 44° C. | A |
| Example 9 | 9 | 3 | 99.55 | 0.012 | 8296 | 10 | 150 | Polypropylene | 1-3 | 44° C. | A |
| Example 10 | 10 | 3 | 99.55 | 0.05 | 1991 | 7 | 150 | Polypropylene | 1-3 | 44° C. | B |
| Example 11 | 11 | 3 | 99.55 | 0.05 | 1991 | 8 | 150 | Polypropylene | 1-3 | 44° C. | A |
| Example 12 | 12 | 3 | 99.55 | 0.05 | 1991 | 14.5 | 150 | Polypropylene | 1-3 | 44° C. | A |
| Example 13 | 13 | 3 | 99.55 | 0.05 | 1991 | 16 | 150 | Polypropylene | 1-3 | 44° C. | B |
| Example 14 | 14 | 3 | 99.55 | 0.05 | 1991 | 10 | 162 | Polypropylene | 1-3 | 44° C. | B |
| Example 15 | 15 | 3 | 99.55 | 0.05 | 1991 | 10 | 159 | Polypropylene | 1-3 | 44° C. | A |
| Example 16 | 16 | 3 | 99.55 | 0.05 | 1991 | 10 | 141 | Polypropylene | 1-3 | 44° C. | A |
| Example 17 | 17 | 3 | 99.55 | 0.05 | 1991 | 10 | 139 | Polypropylene | 1-3 | 44° C. | B |
| Example 18 | 18 | 3 | 99.55 | 0.05 | 1991 | 10 | 150 | Polyethylene | 1-3 | 44° C. | A |
| Example 19 | 19 | 3 | 99.55 | 0.05 | 1991 | 10 | 150 | Fischer-Tropsch | 1-3 | 44° C. | A |

TABLE 2

| | Toner | Value of m and n in formula (1) | PR 57:1 pigment amount part | PY 180 pigment amount part | PR 57:1 amount/ PY 180 amount | Volume average particle size μm | SF1 | Release agent | Binder resin | Glass transition temperature | Blue reproducibility |
|---|---|---|---|---|---|---|---|---|---|---|---|
| Example 20 | 20 | 3 | 99.55 | 0.05 | 1991 | 10 | 150 | Polyester | 1-3 | 44° C. | B |
| Example 21 | 21 | 3 | 99.55 | 0.05 | 1991 | 10 | 150 | Carnauba | 1-3 | 44° C. | B |
| Example 22 | 22 | 3 | 99.55 | 0.05 | 1991 | 10 | 150 | Polypropylene | 2 | 34° C. | B |
| Example 23 | 23 | 3 | 99.55 | 0.05 | 1991 | 10 | 150 | Polypropylene | 3 | 35° C. | A |
| Example 24 | 24 | 3 | 99.55 | 0.05 | 1991 | 10 | 150 | Polypropylene | 4 | 36° C. | A |
| Example 25 | 25 | 3 | 99.55 | 0.05 | 1991 | 10 | 150 | Polypropylene | 5 | 40° C. | A |
| Example 26 | 26 | 3 | 99.55 | 0.05 | 1991 | 10 | 150 | Polypropylene | 6 | 48° C. | A |
| Example 27 | 27 | 3 | 99.55 | 0.05 | 1991 | 10 | 150 | Polypropylene | 7 | 51° C. | B |
| Comparative example 1 | 28 | 5 | 99.55 | 0.05 | 1991 | 10 | 150 | Polypropylene | 1-5 | 44° C. | D |
| Comparative example 2 | 29 | 1 | 99.55 | 0.05 | 1991 | 10 | 150 | Polypropylene | 1-1 | 44° C. | D |
| Comparative example 3 | 30 | 3 | 98.5 | 1.15 | 86 | 10 | 150 | Polypropylene | 1-3 | 44° C. | D |
| Comparative example 4 | 31 | 3 | 99.1 | 0.009 | 11011 | 10 | 150 | Polypropylene | 1-3 | 44° C. | D |
| Comparative example 5 | 32 | 3 | PR 238: 99.55 | 0.05 | 1991 | 10 | 150 | Polypropylene | 1-3 | 44° C. | D |
| Comparative example 6 | 33 | 3 | 99.55 | PY 74: 0.05 | 1991 | 10 | 150 | Polypropylene | 1-3 | 44° C. | D |
| Comparative example 7 | 34 | 3 | PR 238: 99.55 | PY 74: 0.05 | 1991 | 10 | 150 | Polypropylene | 1-3 | 44° C. | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A magenta toner comprising toner particles that contain a colorant and a binder resin, wherein the colorant contains C.I. Pigment Red 57:1 and C.I. Pigment Yellow 180, a mass ratio between the C.I. Pigment Red 57:1 and the C.I. Pigment Yellow 180 being about 99:1 to about 10000:1, and wherein the binder resin contains a polyester resin that has a repeating unit derived from bisphenol A ethylene oxide represented by the following formula (1):

(1)

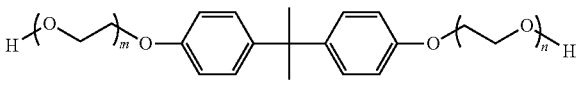

wherein each of m and n independently represents an integer of from 2 to 4.

2. The magenta toner according to claim 1, wherein a volume average particle size of the magenta toner is from about 8 μm to about 15 μm.

3. The magenta toner according to claim 1, wherein a shape coefficient SF1 of the magenta toner is from about 140 to about 160.

4. The magenta toner according to claim 1, wherein the toner particles contain a hydrocarbon-based wax as a release agent.

5. The magenta toner according to claim 1, wherein a glass transition temperature of the magenta toner is from about 35° C. to about 50° C.

6. The magenta toner according to claim 1, wherein the toner particles are obtained by pulverizing a kneaded material after the kneaded material is obtained by kneading a toner forming material that contains the colorant and the binder resin.

7. The magenta toner according to claim 1, wherein a mass ratio between the C.I. Pigment Red 57:1 and the C.I. Pigment Yellow 180 is about 500:1 to about 5000:1.

8. The magenta toner according to claim 1, wherein a proportion of the repeating unit derived from bisphenol A ethylene oxide represented by formula (1) accounting for all the repeating units derived from diol in the binder resin is about 80 mol % or more.

9. A developer comprising the magenta toner according to claim 1.

10. The developer according to claim 9, wherein the glass transition temperature of the magenta toner is from about 35° C. to about 50° C.

11. The developer according to claim 9, wherein the magenta toner particles are obtained by pulverizing a kneaded material after the kneaded material is obtained by kneading the toner forming material that contains the colorant and the binder resin.

12. The developer according to claim 9, wherein a mass ratio between the C.I. Pigment Red 57:1 and the C.I. Pigment Yellow 180 in the magenta toner is 500:1 to 5000:1.

13. The developer according to claim 9, wherein a proportion of the repeating unit derived from bisphenol A ethylene oxide represented by formula (1) accounting for all the repeating units derived from diol in the binder resin in the magenta toner is about 80 mol % or more.

14. A toner cartridge containing the magenta toner according to claim 1 and being detachable from an image forming apparatus.

15. A process cartridge containing the developer according to claim 9, comprising a developing unit developing an electrostatic latent image formed on the surface of a latent image holding member by using the developer to form a toner image, and being detachable from an image forming apparatus.

16. An image forming apparatus comprising:

a latent image holding member;

a charging unit that charges the surface of the latent image holding member;

a electrostatic latent image forming unit that forms an electrostatic latent image on the surface of the latent image holding member;

a developing unit that develops the electrostatic latent image by using the developer according to claim 9 to form a toner image;

a transfer unit that transfers the toner image to a recording medium; and a fixing unit that fixes the toner image to the recording medium.

17. An image forming method comprising:

developing an electrostatic latent image by using a plurality of types of toners to form a plurality of toner images by the plurality of types of toners;

transferring the plurality of toner images by superimposing the images on the surface of the recording medium to form a superimposed multicolor toner image formed of a plurality of layers; and fixing the superimposed toner image to form an image, wherein the plurality of types of toners contain at least the magenta toner according to claim 1 and a cyan toner containing a phthalocyanine-based pigment as a colorant.

18. The magenta toner according to claim 1, wherein a content of the colorant is from 1-20 parts by mass based on 100 parts by mass of the binder resin.

* * * * *